US006848340B2

(12) United States Patent
Lin

(10) Patent No.: US 6,848,340 B2
(45) Date of Patent: Feb. 1, 2005

(54) STRUCTURAL IMPROVEMENT OF A WINE BOTTLE OPENER

(76) Inventor: Chia-Hsien Lin, P.O. Box 82-144, Taipei (TW)

( * ) Notice: Subject to any disclaimer, the term of this patent is extended or adjusted under 35 U.S.C. 154(b) by 0 days.

(21) Appl. No.: 10/456,541

(22) Filed: Jun. 9, 2003

(65) Prior Publication Data

US 2004/0244541 A1 Dec. 9, 2004

(51) Int. Cl.[7] ..... B67B 7/00
(52) U.S. Cl. ..... 81/3.2; 81/3.48
(58) Field of Search ..... 81/3.2, 3.48, 3.49, 81/3.08, 3.09, 3.36, 3.29; 222/5

(56) References Cited

U.S. PATENT DOCUMENTS

| | | | | | |
|---|---|---|---|---|---|
| 5,005,446 | A | * | 4/1991 | Mackey | 81/3.48 |
| 5,012,703 | A | * | 5/1991 | Reinbacher | 81/3.29 |
| 5,020,395 | A | * | 6/1991 | Mackey | 81/3.2 |
| 6,477,920 | B1 | * | 11/2002 | Yang | 81/3.2 |
| 6,502,481 | B1 | * | 1/2003 | Lin | 81/3.2 |
| 6,622,595 | B1 | * | 9/2003 | Federighi | 81/3.48 |
| 2002/0083797 | A1 | * | 7/2002 | Federighi, Sr. | 81/3.2 |

* cited by examiner

*Primary Examiner*—Debra S. Meislin
(74) *Attorney, Agent, or Firm*—Leong C. Lei

(57) ABSTRACT

A structural improvement of a wine bottle opener which includes a syringe, a needle, a cap, a slide jacket and a bottle holder. The syringe is a hollow tube-shaped object, in which a high-pressured Freon can is inserted. The needle is attached to the front end of the syringe, and the cap is attached to the rear. The syringe is then put into the slide jacket, which is a pipe-shaped object with its upper inside perimeter roughly equal to the outside perimeter of the syringe. The slide jacket broadens at the bottom and the inner wall is threaded in order to screw onto the bottle holder. The top of the screw cap has a hole, through which the Freon can inside the syringe can be pressed. The needle is composed of a base and a tube, whereas the base is geometrically shaped and has threads on parts of its surface, enabling the use of hand tools to screw on or off the base from the syringe. The bottle holder comes with a base, which is not only partially threaded, but has a built-in ring mold that has a smaller perimeter. The slide jacket is threaded at the bottom to screw onto the base of the bottle holder. The perimeter of the ring mold is exactly equal to the raised part of the syringe; while two are tightly snugged, it results in the perfect positioning of the syringe.

1 Claim, 6 Drawing Sheets

STRUCTURAL IMPROVEMENT OF A WINE BOTTLE OPENER

BACKGROUND OF THE INVENTION

1. Field of the Invention

The present invention relates to the structural improvement of a wine bottle opener that removes the cork safely and quickly, and in particular refers to one kind of wine bottle opener.

2. Description of the Prior Art

In today's marketplace, bottles of grape wines and various distilled alcohols are often sealed with corks. The process of removing the corks is often done by a wine bottle opener. FIG. 1 depicts a relatively non-destructive wine bottle opener already on the market employing existing technology. It comprises mainly an inner tube (11), an outer tube (12), an elastic tube (13), a needle (14), a position-holding plank (15), and a cap (16). By inserting the needle (14) at the front of the inner tube (11) into the cork and pressing the cap (16) lightly for a few seconds, the Freon can in the inner tube (11) then ejects high-pressured air through the needle, producing upright pressure inside the bottle, thus pushing the cork out of the bottle.

However, the wine bottle opener described above has the following imperfections:

1. Once the bottle opener is assembled, it cannot be disassembled. Although the structure as a whole is fairly sturdy, the size of the needle (14) is relatively thin. If the opener is not held steady, the needle may deform or break easily. Furthermore, the tip of the needle might wear off; making it hard to operate. Ultimately, the bottle opener will be considered useless when it has a needle that is not usable or replaceable.

2. While using the bottle opener, it is inevitable that some liquid may spurt or drip, and remain at the inner wall of the elastic tube (13), or even pass through the hole (131) and stay between the inner tube (11) and the elastic tube (13). Because the opener cannot be disassembled and thus making it hard to clean, it can easily present potential hygienic issues.

SUMMERY OF THE INVENTION

Accordingly, it is the objective of the present invention to improve the imperfections of the above-described wine bottle opener, and develop diligently a more advanced product The present invention comprises mainly a syringe, a needle, a cap, a slide jacket, and a bottle holder. The syringe is a hollow tube-shaped object, in which a high-pressured Freon can is inserted. The needle is attached to the front end of the syringe, and the cap is attached to the rear. The syringe is then put into the slide jacket, which is a pipe-shaped object with its upper inside perimeter roughly equal to the outside perimeter of the syringe. The slide jacket broadens at the bottom and the inner wall is threaded in order to screw onto the bottle holder. The top of the cap has a hole, through which the Freon can inside the syringe can be pressed.

The needle is composed of a base and a tube. The base is geometrically shaped and has threads on parts of its surface, enabling the use of hand tools to screw on or off the base from the syringe.

The bottle holder comes with a base, which is not only partially threaded, but it also has a built-in ring mold with a smaller perimeter. The slide jacket is threaded at the bottom to screw onto the base of the bottle holder. The perimeter of the ring mold is exactly equal to that of the raised part of the syringe. When the two are matched snugly, the result is the perfect positioning of the syringe.

The primary objective of the present invention is to provide the structural improvement for one kind of wine bottle opener in particular by utilizing simpler structure and method of assembly. As a result, it minimizes the use of material and the cost of the production process. At the same time, it provides the consumers the advantage of simple assembling/disassembling, as well as the assurance that hygiene will never be an issue as the whole cleaning process has been made much easier.

The other objective of the present invention is to provide the structural improvement of one kind of wine bottle opener in particular, whereas the components can be disassembled and/or replaced easily, and thus lengthening the life of the product.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

For the purpose of promoting a better understanding of the structural features, method of assembly, and other purposes of the present invention, a detailed description is shown in the following paragraph by a preferred embodiment in conjunction with drawings.

Figure 1:
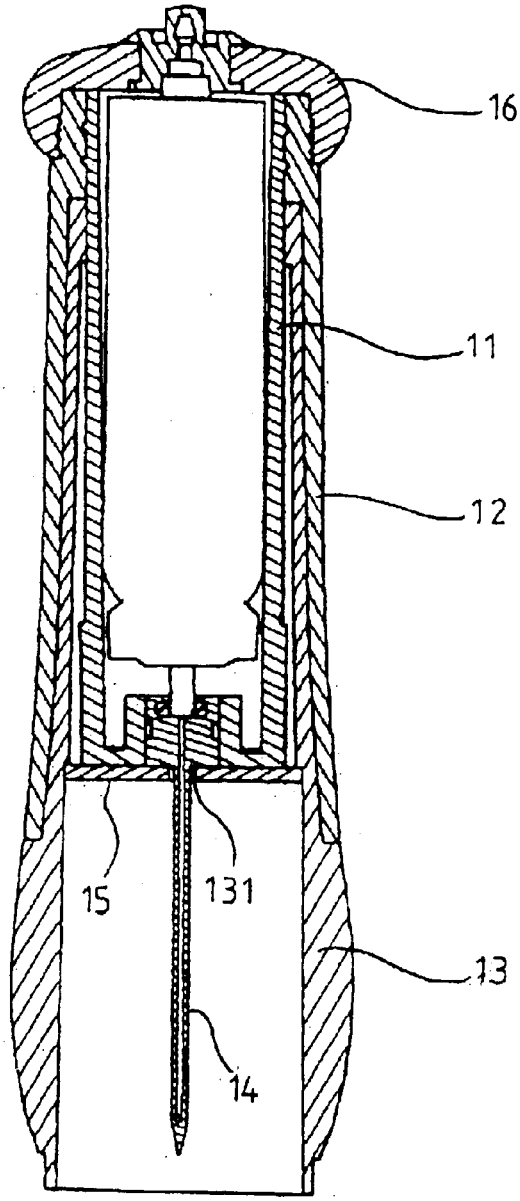
PRIOR ART FIG. 1
FIG. 1 is a sectional view showing the structure of an existing wine bottle opener.
Figure 2:
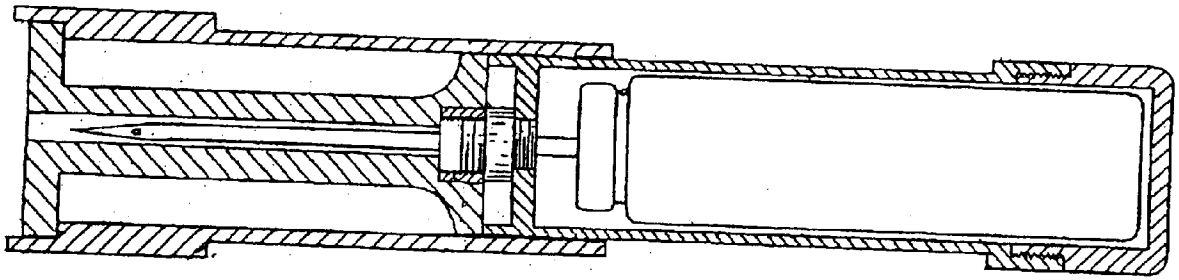
PRIOR ART FIG. 2
FIG. 2 is a sectional view of U.S. Pat. No. 6,502,481 which is also owned by the applicant of the present invention.

In order to obviate the drawbacks of the prior art opener, the inventor has designed the present invention based upon the U.S. Pat. No. 6,502,481 (see FIG. 2) which is also owned by the inventor of the present invention.

Figure 3:
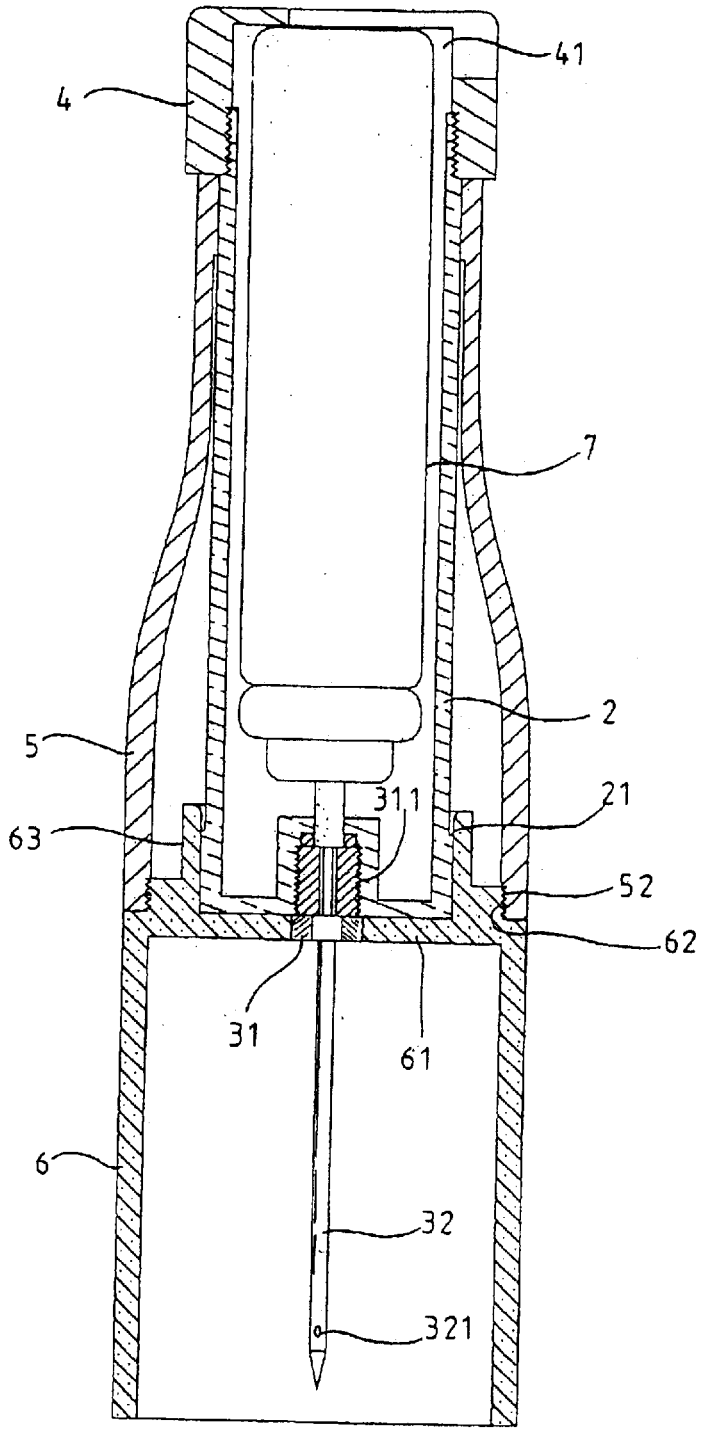
FIG. 3 is a sectional view of the main components of the present invention, shown together.
Figure 4:
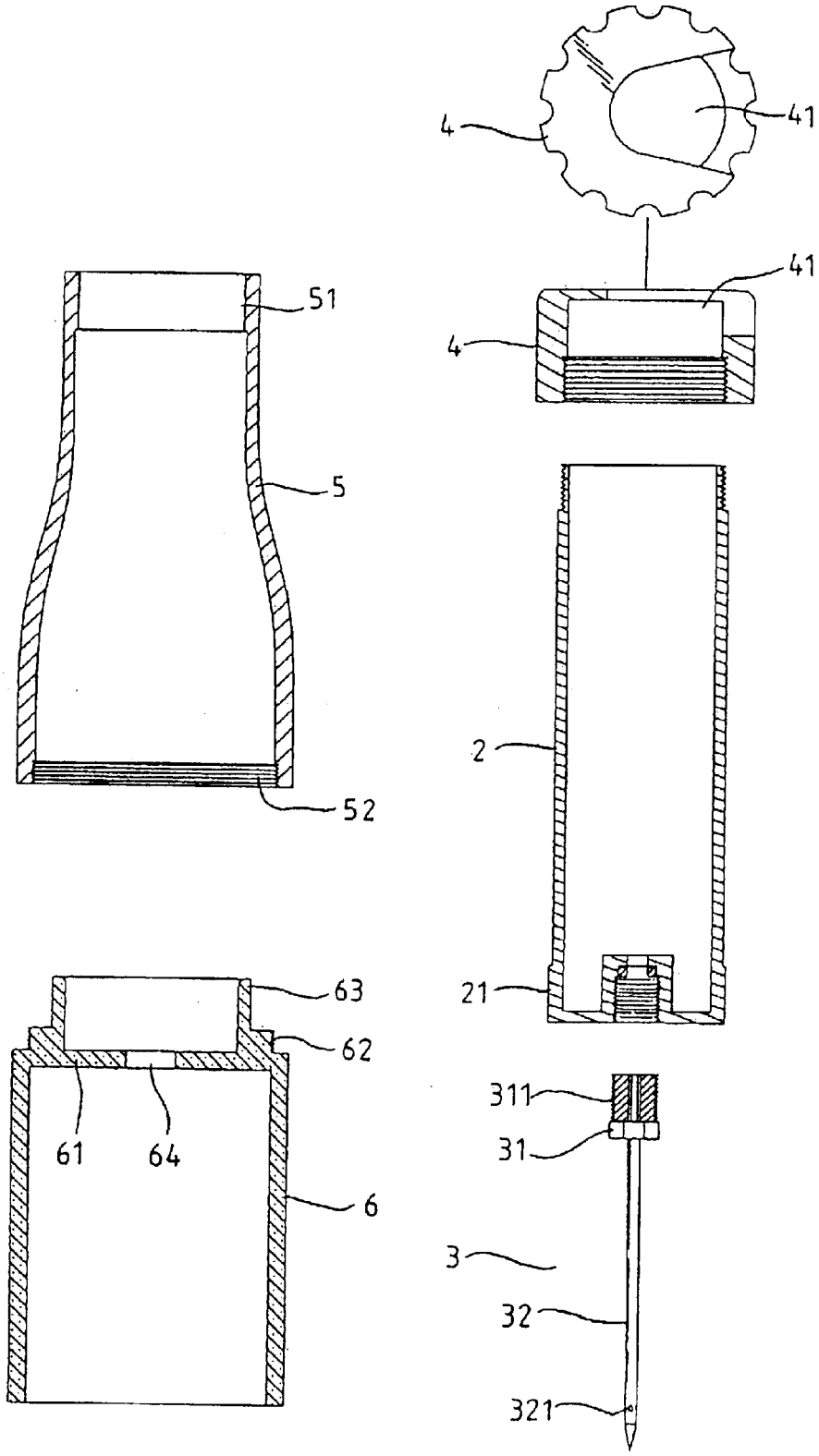
FIG. 4 is a sectional view of the main components of the present invention, shown separately.

First of all, referring to FIGS. 3 and 4, the present invention relates to the structural improvement of one kind of wine bottle opener in particular, which comprises mainly a syringe (2), a needle (3), a cap (4), a slide jacket (5), and a bottle holder (6).

The syringe (2) is a hollow tube-shaped object, within which a high-pressured Freon can (7) is inserted. The needle (3) is attached at the central position of the syringe (2) at the front end, and the cap (4) is attached at the rear. The front end of the syringe (2) comes with a raised ring (21); the perimeter of which is slightly bigger than that of the syringe (2).

The needle (3) is composed of a base (31) and a tube (32). The base (31) is geometrically shaped, and is threaded on parts of its surface (311), enabling the use of hand tools to screw on or off the needle (3) from the syringe (2). Moreover, the front end of the tube (32) is made with at least one air hole (321).

The cap (4) is threaded to screw onto the syringe (2), and has an open hole (41) on the top, through which the Freon can (7) inside the syringe (2) can be pressed.

The slide jacket (5) is a pipe-shaped object. Its upper inner perimeter is roughly equal to the outer perimeter of the syringe, and is made with a resistant ring (51) at the upper inner wall. The ring is in similar shape as the raised ring of the syringe, so that the syringe (2) can attach to the jacket (5) without sliding off. The slide jacket (5) broadens at the bottom, and is threaded at its inner wall to screw onto the bottle holder (6).

The bottle holder (6) has a base (61), which is not only threaded (62), but it also has a built-in ring mold (63) with a smaller perimeter. The slide jacket (52) can be screwed onto the bottle holder (62). At the geometric center of the base is a hole (64) that, with a proper size, allows the needle to go through. The inner perimeter of the ring mold (63) is exactly equal to that of the raised ring of the syringe (2); when the two are tightly snugged, it results in perfect positioning of the syringe (2).

Figure 5:
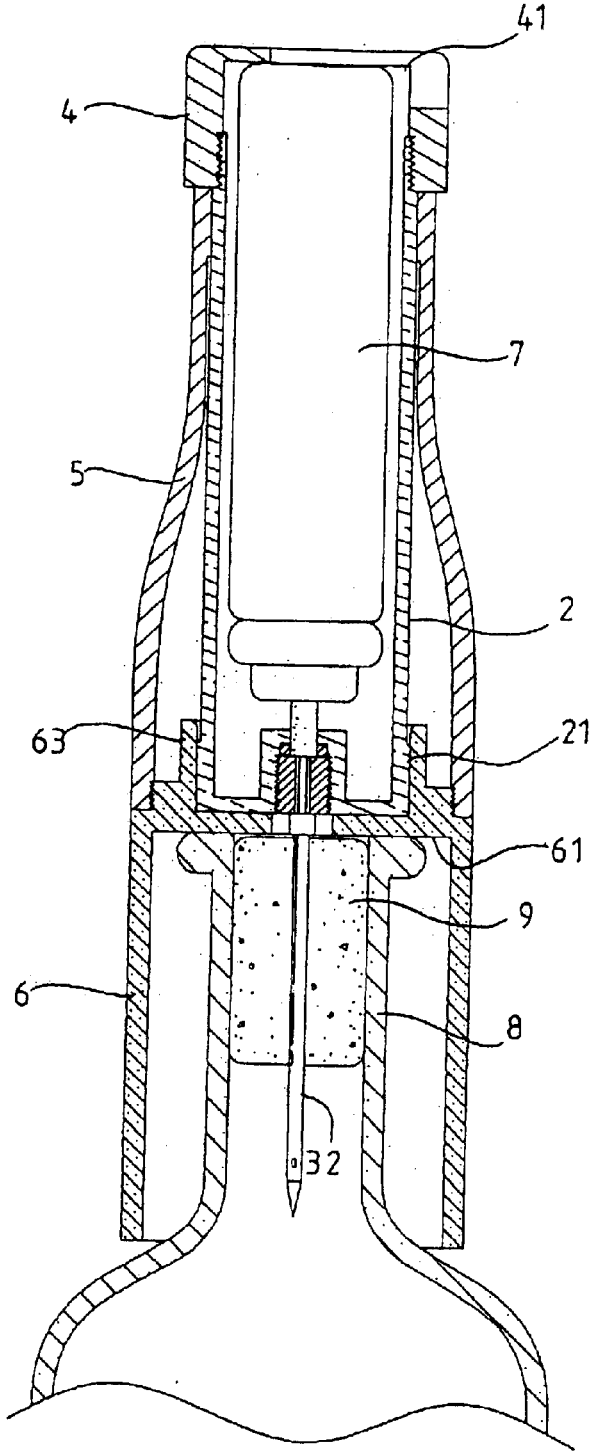
FIG. 5 is a reference drawing showing the operation of the present invention.
Figure 6:
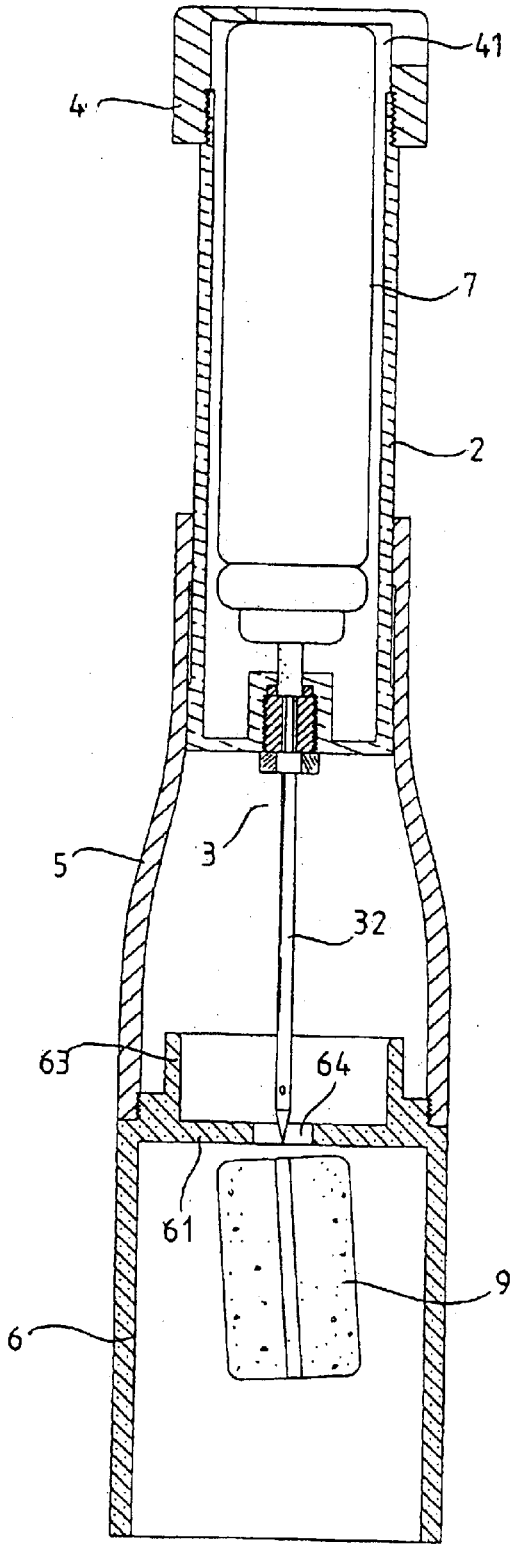
FIG. 6 is a drawing showing the action of removing the cork with the present invention.

The present invention relates to the structural improvement of a wine bottle opener, and its operation is demonstrated in FIGS. 5 and 6. First, hold the slide jacket (5) and the cap (4), and cover the mouth of the bottle (8) with the bottle holder (6) and move downward. At the mean time, the needle tube (32) is gradually inserted into the cork (9) until the mouth of the bottle touches the base (61) of the bottle holder (6), thereby positioning the pointed end of the needle roughly between the cork (9) and the surface of the liquid inside the bottle. Then press lightly on the rear end of the Freon can (7) through the open hole (41) on the cap (4), releasing high-pressured air, which flows along the needle tube (32) and through the hole into the bottle. It then creates upward pressure inside the bottle, which easily and quickly pushes the cork out.

The cork (9) usually attaches to the needle tube (32) after being removed from the bottle. Move the slide jacket (5) and the syringe (2) in opposite direction, then the base (61) of the bottle holder (6) will push the cork off the needle tube (32), as shown in FIG. 5.

While not in use, push the syringe (2) towards the bottle holder (6) so that the raised ring (21) will tightly fit into the ring mold (63), thus repositioning the syringe (2).

Through the comparison of the above-described embodiment with the imperfections of the existing bottle opener, the present invention is able to achieve the following results:

1. By means of the structural union of the bottle holder and the slide jacket, it is easy for the consumers to disassemble and clean the components, thus ensuring better hygiene when utilizing the product.
2. When the needle tube of the syringe is broken or no longer usable, the present invention provides for easy disassembling, and through the acquisition of replacement components, the life of the product can be lengthened.

Generally speaking, the present invention indeed provides its users a kind of wine bottle opener that is safe and easy to operate. Its components are simple and easy to make, making it suitable for mass production, and thus is hereby proposed for patent application. However, the aforementioned preferred embodiment is used to describe but not to limit the present invention, and it is subject to any refinement and modification, by those skilled in the art, within the principles of this invention. Therefore, the protection of the present invention is based on what is defined by the enclosed claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structural improvement of a wine bottle opener comprising a syringe, a needle, a cap, a slide jacket, and a bottle holder, wherein the syringe is a hollow tube-shaped object within which a high-pressured Freon can is inserted, a central position of an end of the syringe is attached by the needle, and the cap is attached to another end of the syringe, the syringe is put in the slide jacket which is a tube-shaped object that has an inner perimeter at an upper end that is roughly equal to an outer perimeter of the syringe, the slide jacket broadens at a bottom and is threaded to screw onto the bottle holder; the top of the cap has an open hole through which the Freon can inside the syringe can be pressed, the needle is composed of a base and a tube, a main body of the base is shaped geometrically and is threaded on a part of a surface thereof, enabling use of hand tools to screw on or off the needle from the syringe, the bottle holder comes with a base and is threaded for engaging the slide jacket, the bottle holder has a ring mold having an inner perimeter which is equal to an outer diameter of the raised ring of the syringe.

* * * * *